US006254714B1

(12) United States Patent
Niedermeyer

(10) Patent No.: US 6,254,714 B1
(45) **Date of Patent: *Jul. 3, 2001**

(54) METHOD AND APPARATUS FOR UNDERGARMENT ASSEMBLY

(76) Inventor: William P. Niedermeyer, 1024 Mt. Mary Dr., Green Bay, WI (US) 54311

( * ) Notice: Subject to any disclaimer, the term of this patent is extended or adjusted under 35 U.S.C. 154(b) by 0 days.

This patent is subject to a terminal disclaimer.

(21) Appl. No.: 09/251,057

(22) Filed: Feb. 18, 1999

Related U.S. Application Data

(63) Continuation-in-part of application No. 08/901,914, filed on Jul. 29, 1997, now Pat. No. 5,904,802.

(51) Int. Cl.[7] ..... B32B 31/00; A61F 13/15

(52) U.S. Cl. ..... 156/256; 156/160; 156/176; 156/201; 156/204; 156/227; 156/269; 156/300; 156/302; 156/436; 156/465; 156/519; 156/520; 156/552

(58) Field of Search ..... 156/256, 269, 156/270, 297, 299, 300, 302, 517, 519, 520, 204, 201, 202, 227, 160, 176, 436, 465, 552

(56) References Cited

U.S. PATENT DOCUMENTS 4,578,133 * 3/1986 Oshefsky et al. ..... 156/164
5,584,954 * 12/1996 Van Der Klugt ..... 156/265
6,017,406 * 1/2000 Vogt ..... 156/73.1

* cited by examiner

*Primary Examiner*—Linda Gray

(57) ABSTRACT

A machine which fabricates an undergarment assembly having an openable front panel. The assembly is made from two continuous half width webs. The first and second web paths are transversely spaced. It includes devices to add a V-folded reinforcing strip along the edge of one web. Devices are included to add elastic strands adjacent the central crotch section and a re-closable tape across the front panel opening. One of the webs is printed with adhesive at spaced longitudinal intervals to bond portions of the two overlapped webs in central areas to define a bonded full width rear panel. The machine cuts leg openings and pad securement flaps on the outer margins of each half web. After assembly, the web is severed into unit products for delivery and packaging. The delivery system includes vacuum rolls for transferring flat product or longitudinally and transversely folded product for package size reduction. The machine applies tapes that protrude from side margins for manual taping connection of front and rear panels after folding the product around a user's crotch.

18 Claims, 4 Drawing Sheets

FIG. 14
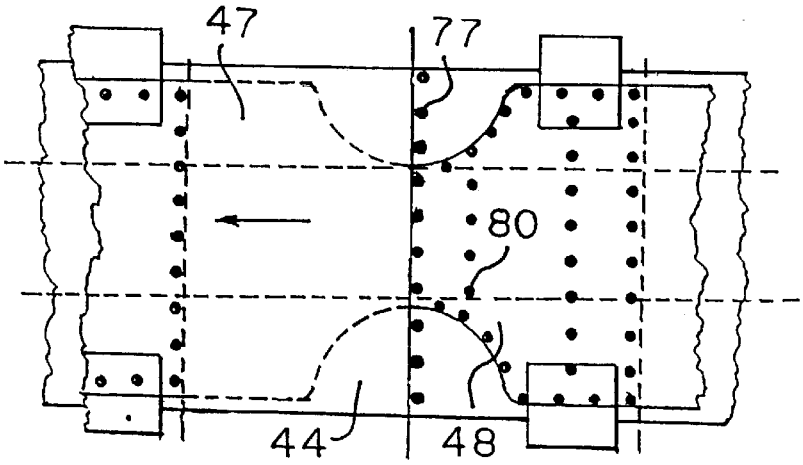
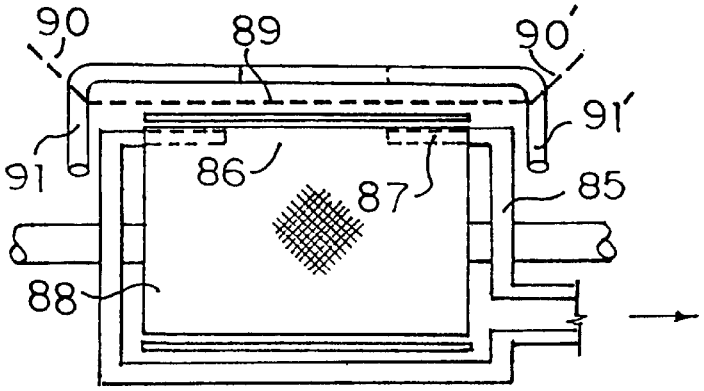
FIG. 16
FIG. 15
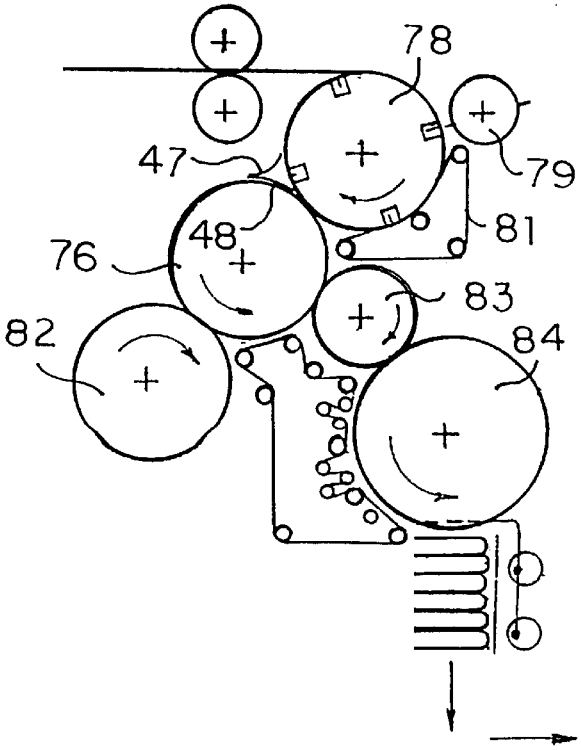

METHOD AND APPARATUS FOR UNDERGARMENT ASSEMBLY

This application is a continuation-in-part of application Ser. No. 08/901,914, filed Jul. 29, 1997, now U.S. Pat. 5,904,802.

FIELD OF THE INVENTION

This invention relates to apparatus for fabricating a undergarment assembly similar to disposable diapers but without an integral absorbent pad, and having a front panel opening.

Machinery for making disposable diapers includes pulp roll advancement and de-fiberizong equipment to product absorbent fluff for the pad, and components for intergating the pad, garment facing and backing sheets.

U.S. Class 604 includes literally hundreds of disposable diaper patents involving materials and features of the absorbent pad as part of the diaper.

Undergarment briefs produced by the instant apparatus are described in U.S. Class 2 which includes a variety of undergarments having, or made to accept, separate absorbent pads.

Undergarment briefs of this type, but with an openable front panel are describd in U.S. Pat. No. 5,864,890. The apparatus for making the '890 product is described in U.S. patent application Ser. No. 08/901914, U.S. Pat. No. 5,904, 802.

BACKGROUND OF THE INVENTION

The apparatus of U.S. application Ser. No. 08/901914, U.S. Pat. No. 5,904,802 has provision to accept and combine absorbent pads made separately ,but it is primarily intended to describe apparatus for making briefs with a front opening.

That feature permits the user to 'step into' the garment for wear with or without adding a commercially available hygienic or absorbent pad specifically designed for the amount of bodily fluids being expelled.

Because the product of U.S. Pat. No. 5,864,890 is a completed garment, the apparatus for making them requires a carrier drum to advance segments, fold the front panel over the rear panel, and means to fold and secure flaps protruding from the side margins to complete the leg and waist apertures.

The product made with the instant apparatus is not a completed garment and therefore certain elements of the earlier U.S. Ser. No. 08 901,914, U.S. Pat. No. 5,904,802 teaching are eliminated.

SUMMARY OF THE INVENTION

This invention is a continuation-in-part of U.S. application Ser. No. 08/901914 for apparatus used to make the completed brief of U.S. Pat. No. 5,864,890.

Unlike '914, this invention describes apparatus to produce stacks of brief assemblies that do not have leg and waist apertures until certain folding and tape securement tasks are completed by the user, like disposable diapers.

The apparatus of '914 uses a folding drum having movable folding fingers according to earlier U.S. Pat. No. 5,795,433, and the instant invention eliminates the folding devices and drum by using other unique combinations of machine components.

For stacks delivered in flat form, the inventive apparatus can use stacking devices similar to U.S. Pat. No. 3,141,667 of Novich or U.S. Pat. No. 3,298,683 of Stroud.

For lower bulk, briefs can be folded for packaging using the apparatus of U.S. Pat. No. 3,254,889 of Nystrand or U.S. Pat. No. 3,823,935 of Guichard.

In the instant apparatus, combined webs are advanced through fabrication steps including adhesive printing of pre-selected areas to bond selected areas between plies, and application of other product components requiring vacuum transfer.

The high speed operation of disposable diaper machines is due largely to the fabrication of materials while they are in web form.

Similar methods are used in this invention to fabricate briefs with a front opening or 'fly' in the front panel.

The apparatus advances two webs, each of about half width of the product, and using 'reverse' folding plates to apply a reinforcing strip on one or more edges, web paths are arranged to partially overlap.

The instant apparatus advances two half width webs, applies adhesive to pre-selected areas of one web, joins the webs in overlapping relationship to bond the rear panel portions together, adds a closure tape to connect non-bonded front panel portions which define a front opening, attach cs tapes that protrude from each side margin of the rear panel (like disposable diapers), and cuts the assembly into discreet units that are later placed around the crotch of the user and attached at both sides to complete the garment leg and waist apertures.

The primary object of the invention is to define apparatus for making brief assemblies having a reclosable opening but without the front and rear panels connected.

Another object is to eliminate the movable folding fingers and carrier drum used in U.S. application Ser. No. 08/901914, U.S. Pat. No. 5,904,802 and described in earlier U.S. Pat. No. 5,795, 433.

Another object is to make brief assemblies and deliver stacks of flat or folded briefs for package size reduction.

Other objects of the invention may be seen in the ensuing specifications.

BRIEF DESCRIPTION OF THE DRAWINGS

FIG. 14 is a top plan view of a web portion superposed on folding/delivery roll of FIG. 15 illustrating a typical arrangement of vacuum ports for the sequence of cutting into discreet units, folding, cutting to shape, and delivery.

FIG. 15 is a schematic side elevation illustrating an arrangement of rolls for the sequence described above for FIG. 14.

FIG. 16 is an end cross section of the vacuum belt transport system used to control the product during longitudinal folding into three panels.

DETAILED DESCRIPTION

Figure 1:
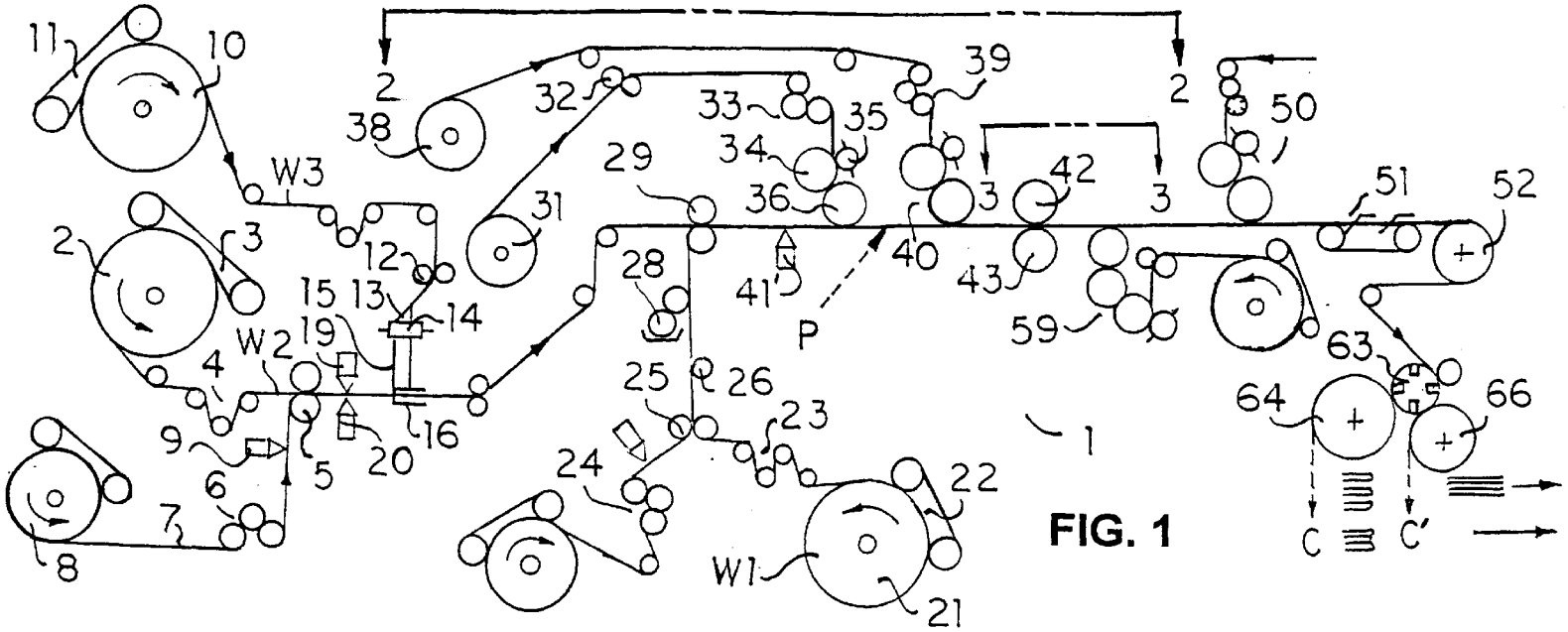
FIG. 1 is a schematic side elevation illustrating apparatus to manufacture briefs.
Figure 4:
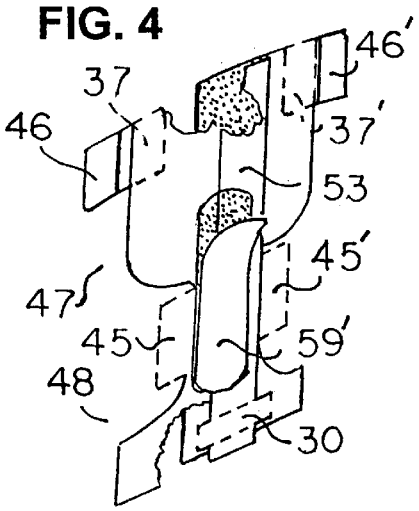
FIG. 4 is a perspective view of the instant web assembly after die cut shaping and cutoff.

In FIG. 1, the manufacturing apparatus 1 substantially completes the undergarment assembly shown in FIG. 4 while materials are in web form, and delivers the product assembly in stacks of unfolded flat form, or in another embodiment, as stacks of longitudinally and transversely folded product.

In FIG. 1. web W2 is unwound from supply roll 2 by belt 3. Web W1 and W2 are referred to as first and second webs herein.

Web W2 is advanced through a 3-roll constant tension system 4 by a set of pull rolls 5. Concurrently, a set of three coacting rolls 6 draw a pair of elastic strands 7 from supply roll 8.

Elastic strands 7 pass through the nip of s-wrap roll set 6 which are arranged to advance the elastic at a velocity lower than the velocity of web W2 thus inducing tension in the elastic strands.

The elastic strands pass under adhesive application means 9 for spaced adhesive and subsequent spaced attachment at roll set 5 to a central crotch portion of web W2 under tension.

In FIG. 1, a narrow web strip W3 is unwound from supply roll 10 by belt 11 and passes throught the nip of pull roll pair 12 mounted above folding plate 13.

A second pair of draw rolls 14 at the tip of folding plate 13 has a variable speed drive (not shown) to create tension in the web moving over folding plates 16. The apex of the folded web is along margin 15.

Figure 2:
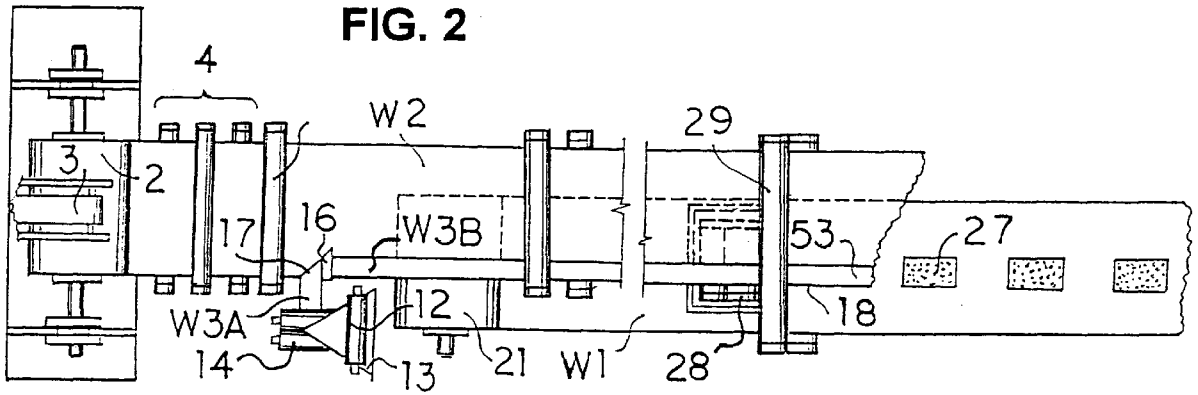
FIG. 2 is a top plan viewed from sight line 2—2 of FIG. 1 illustrating separation and offset advancement of two webs with a strip reinforcing web added to one web.
Figure 3:
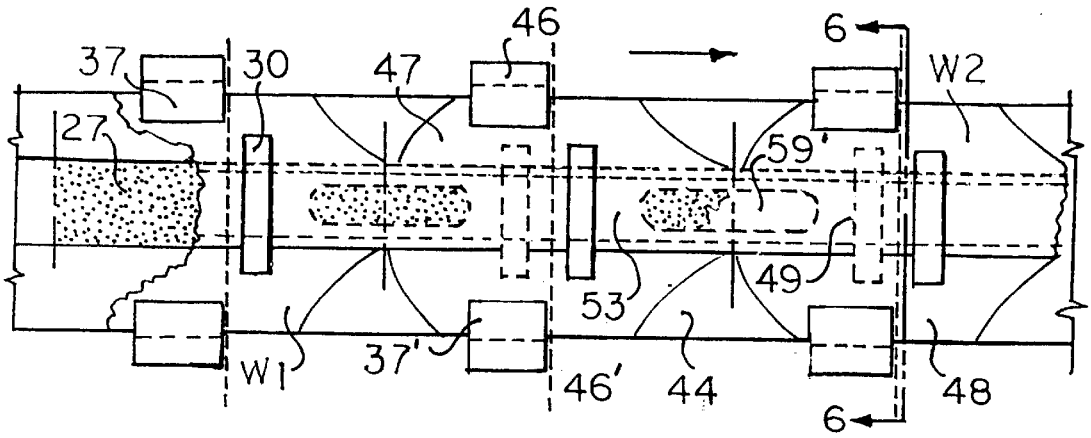
FIG. 3 is a top plan viewed from sight line 3—3 of FIG. 1 illustrating the web and components substantially assembled before cutoff into discreet units.

Referring briefly to FIGS. 2 and 3, the V-folded web is advanced from pull rolls 14 (see FIG. 2) over guide rolls (not seen) to the incoming web position W3 A, advanced over the top and bottom outside surfaces of inverse folding plates 16 , around the 45 degree angles edges 17, and is reverse folded to slide over inside surfaces and exit from plate pair 16 with the web W3 B directed 90 degrees from the direction of the incoming web—in effect, a 90 degree turn involving a reversal of inside and outside surfaces before and after the web fold.

The apex of the folded web is along edge 18 after its exit from plates 16.

Figure 5:
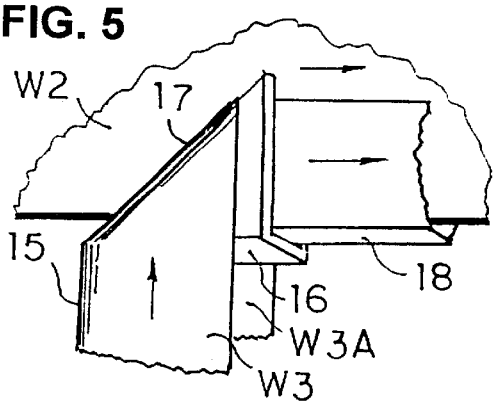
FIG. 5 is a perspective view of the reverse folding plates to fold and direct the narrow reinforcing web W3.

In FIGS. 2 and 5, the second web W2 is shown entering the space between the reverse folded portions of strip W3 and is enclosed therebetween.

The reinforcing strip W3 is attached to adhesive applied to both sides of W2 with applicators 19 and 20.

In FIG. 5, means to change spacing between upper and lower angled plates 16 can be provided (not shown) to increase spacing when W2 or W3 spliced joints are sensed upstream, and can be reduced to normal spacing using automatic controls.

It is further noted that while strip reinforcing web is shown being added to one web, duplicate but oppositely handed means can be used to add a strip to web W1.

In FIG. 1, first web W1 is concurrently fed from supply roll 21 by unwind belt 22 and passes through a 3-roll constant tension system 23.

With a system 24 similar to elastic feed and tensioning apparatus described above for web W2, the elastic is tensioned and adhesive is applied at spaced intervals before it is attached to web W1 at pull roll set 25.

Intermediate guide rolls 26 can be grooved to prevent adhesive offset to roll surfaces.

Before being joined to web W2, the underluying web W1 (see FIGS. 3 and 6) has adhesive applied to a restricted spaced area 27 in the central overlapped region by printer 28.

The spaced area of adhesive 27 (see left side of FIG. 3) joins the two half width webs into a full width web at spaced intervals of the overlapped portions between plies of the rear panel, and by leaving a portion not printed (space between areas 27), the unbonded overlap becomes the front panel opening.

It is noted that when the longitudinal dimension of printed area 27 exceeds 50% of product length, a limited but beneficial bonding occurs between 2 plies of the front panel near the crotch.

In FIG. 1, web W1 is advanced to the nip between rolls set 29 and bondably joined in the spaced apart areas 27 to web W2 including the reinforcing strip W3 that encloses one margin.

In FIGS. 2 and 3, the conjoined webs are viewed with web W2 overlapped as the top web.

In other embodiments,webs can be interchanged.

Before reaching die cutting rolls, a releasable closure tape 30 (see FIG. 3) is attached to the top of web W2 and extends over the folded edge of the reinforcing strip for attaching connection between the two half width webs which become the front panel when the briefs are folded around the crotch by the user.

In the top left of FIG. 1, a closure tape supply roll 31 is pulled by nip rolls 32 and threaded around S-wrap roll set 33.

The web for tapes 30 is flexible but substantially non-extensible.

With a disc brake or equal means to provide resistance, the tape web being fed into roll set 32 and S-wrap rolls 33 has enough tension to prevent overfeed while advancing (for example) a 1" long segment into the space between anvil roll 34 and coacting knife roll 35 when the knife-anvils are not in contact between cuts.

Vacuumized anvil roll 34 advances the tape segment to vacuum transfer roll 36 for extending attachment to web W2.

In FIG. 1, two webs for tapes 37, 37' are advanced from supply roll 38, threaded over guide roll (not referenced) and around S-wrap pull rolls 39 for segment transfer to cutoff roll set 40 in a segment feeding system similar to U.S. Pat. No. 3,728,191 and other prior art.

Referring to FIG. 1, an absorbent pad P of conventional design can be manufactured by upstream apparatus and adhesively attached to areas 41' on the inside of the garment (see FIG. 3) by adhesive applied at applicator 41.

In another embodiment, applicator 41 can be located to the left of roll set 29 (not shown) for addition of the pad to the underside of web W2.

Figure 10:
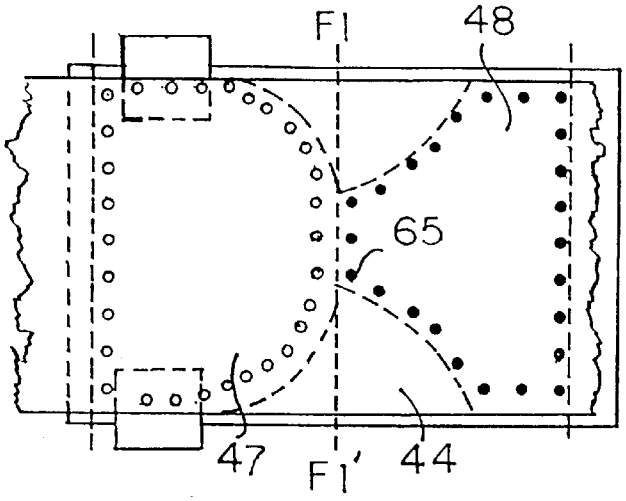
FIG. 10 is a top plan view of a web portion superposed on the surface of a folding and delivery roll of FIG. 9, illustrating a typical vacuum port arrangement in the roll surface for the sequence of cutting to shape, cutting into discreet units, folding and delivery.

After side margin and closure tapes, waistbands, etc. are added, the overlapped webs (adhesively bonded between plies of the rear panel and tape connected on the front panel) pass through the nip between coacting die cutting roll 42 and anvil roll 43 to shape typical leg cutouts 44 in both sides of the web assembly (see FIGS. 3 and 10).

Referring briefly to FIG. 4, pad securement flaps 45, 45' (shown phantom) can be shaped by die cutting set 42, 43 to extend from the central crotch region.

Means to fold these flaps for 'temporary' deployment before use are not shown but would be similar to the longitudinal folding system 51 in FIG. 1.

In FIG. 4, cover strips 46, 46' are removed from tapes 37, 37' respectively and connect rear panel 47 to front panel 48 after the front panel is folded back and superposed against the rear panel.

The perspective view of FIG. 4 illustrates the addition of side margin tapes 46, 46' (means not shown FIG. 1) and front panel closure tape 30 as viewed from sight line 3—3 in FIG. 1.

Figure 9:
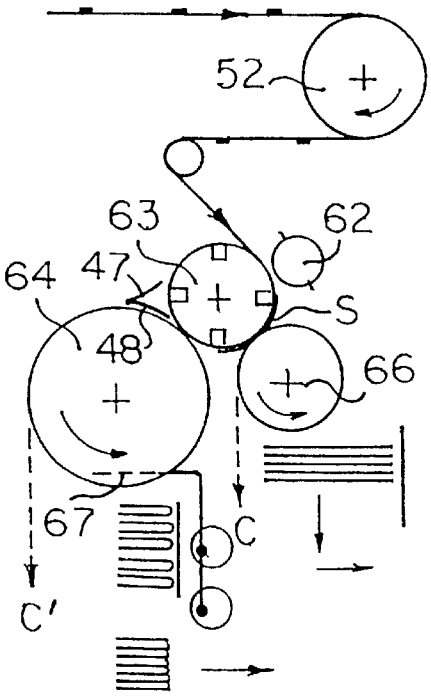
FIG. 9 is a schematic side elevation illustrating the apparatus for delivering stacks of flat product or stacks of half folded product.

In FIG. 3, the rear panel leads in the direction of movement and tapes are upward as the web assembly approaches die roll 42. As the assembly advances through the die cutting set 42, 43 it passes around vacuum transfer roll 52 and tapes are downwardly facing as shown in FIG. 9.

Referring back to FIG. 1, after side tapes 37, 37' are in place, segment feeding apparatus 50 adds waistband 49 (see FIG. 3) to the rear panel between the side tapes.

In FIG. 1, after system 50 adds a waistband, folding device 51 folds the 'wing' portions to reduce produce width (fold rods shown staggered in FIG. 16).

FIG. 5 is a detailed perspective view of the inverse folding device for the reinforcing strip as illustrated in FIGS. 1 and 2.

Figure 6:
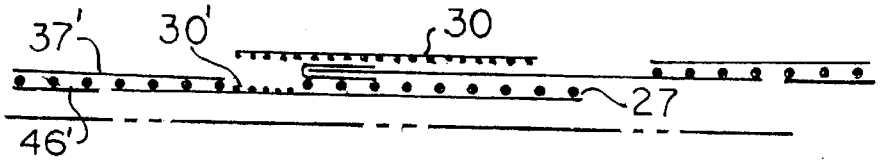
FIG. 6 is a cross sectional end view of the web assembly viewed from line 6—6 of FIG. 3.

In FIG. 6 web components are shown on one side of (above) the fold line F1–F1' as a complete product in flat form. Any folds and side tape connections for completion of the leg and waist apertures occur below the fold line and are completed by the user (like disposable diapers).Tape 30 is attached to release area 30'

Figure 7:
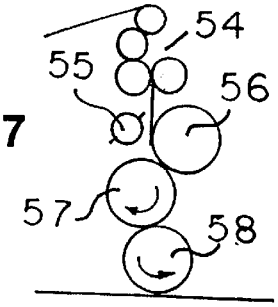
FIG. 7 is a schematic side elevation illustrating a segment advancement, cutoff, and transfer device used for adding components to the top of a web assembly.

In FIG. 7, an S-wrap feed roll couple 54 advances a web at a slow speed to advance a portion that protrudes downwardly in the space between the knife cutoff roll 55 and the coacting anvil roll 56.

During the interval between cuts, the advanced segment is in sliding contact with anvil roll 56 which has vacuum ports at small segment repeats, and when the cutoff roll roates to the cut position, a small segment (such as a tape) is free to advance at web speed on the surface of anvil roll 56 for transfer to the web via rolls 57 and 58.

Figure 8:
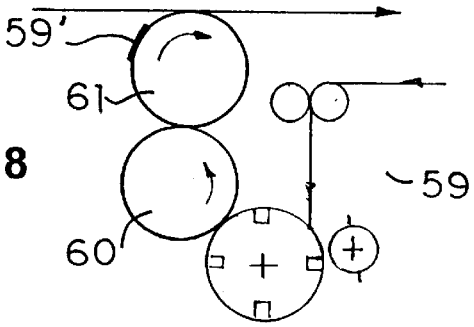
FIG. 8 is a schematic side elevation iillustrating a segment advancement, cutoff and transfer device used to add components to the underside of the web assembly.

In FIG. 8, a similar feed, cutoff and transfer system 59 advances and cuts a cover strip segment 59' shorter than product length and die cuts a shape in the segment with die roll 60 before vacuum roll 61 transfers the shaped cover strip for attachment to pad adhesive 27 on the underside of web W2.

Referring to FIGS. 9 and 10, the web assembly (W1, W2, and W3) is advanced around transfer roll 52 with tapes now on the underside of the web assembly.

Knife roll 62 severs the web assembly into segments S. Anvil roll 63 is vacuumized and advances the leading cut edge to a roll position at about 280 degrees as viewed.

The leading rear panel portion 47 is held to anvil roll 63 until vacuum is stopped at about 275 degrees.

The trailing front panel portion 48 is held by vacuumized apertures shown solid in FIG. 10, and as folding roll 64 rotates, a plurality of vacuum ports 65 along fold line F1–F1' holds the trailing panel 48 near the fold line and causes rear panel 47 to be slidably pulled from the surface of roll 63, resulting in a half fold to reduce packaging size.

In FIG. 10, vacuum ports for rear panel 47 are shown as circles whereas ports to hold the front panel are shown solid, noting that the same pattern of ports is on both rolls 63, 64 and 66.

Referring again to FIG. 9, roll 66 is a vacuum transfer roll for flat delivery and stacking of the product.

For reduced package size, roll 64 half folds the product and advances it until orbital packer fingers 67 strip the product into stacks.

In FIG. 9 products with defects can be detected upstream and culled in direction C by intermittently interrupting vacuum for roll 66 (for flat pack) or roll 64 (for stacks of folded product)

Figure 11:
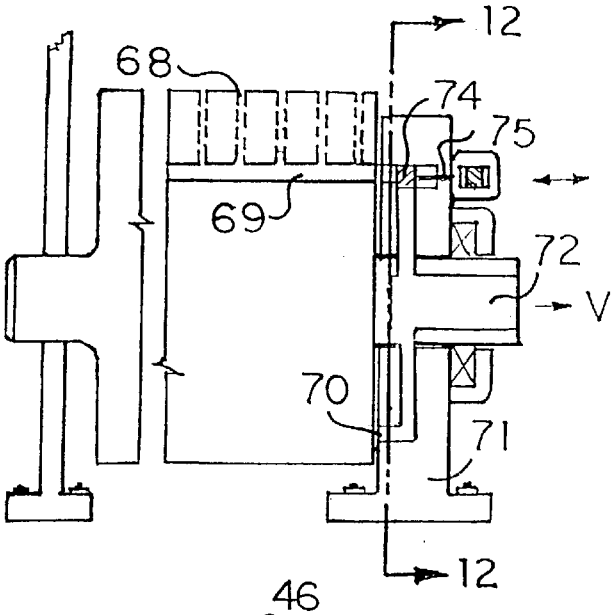
FIG. 11 is a schematic cross-sectional view of a vacummized rotating roll coacting with a stationary vacuum valve with a movable slug.

FIG. 11 shows a typical plurality of ports 68 communicating with vacuum manifold 69 in a typical rotating roll.

The circular free end of manifold 69 rotates in sliding contact with annular vacuum groove 70 in stationary valve half 71, as viewed from sight line 12—12 of FIG. 11.

Annular groove 70 communicates with the central hollow shaft 72 via radial channels 70'.

Figure 12:
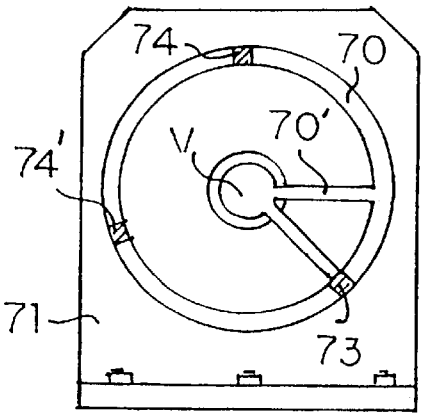
FIG. 12 is a side view of the stationary portion of a two-part vacuum valve viewed from sight line 12—12 in FIG. 11.

For example, in FIG. 12, vacuum V is only available in the groove between positions 73 to 74 and 74 to 74'.

Referring to FIG. 11, the crosshatched slug in position 74 is connected to and movable with actuator solenoid rod 75, and by slideable retraction into slug cutouts in the frame, (not referenced for clarity), slug 74 can be moved to restore the full vacuum path between 73 and 74'.

In effect, the solenoid actuator causes variable duration of the effective vacuum, and in reverse, interruption of the vacuum path 73–74' would result in shorter groove and vacuum from 73 to 74. Interruption of vacuum causes defective product to be culled along paths C.

Figure 13:
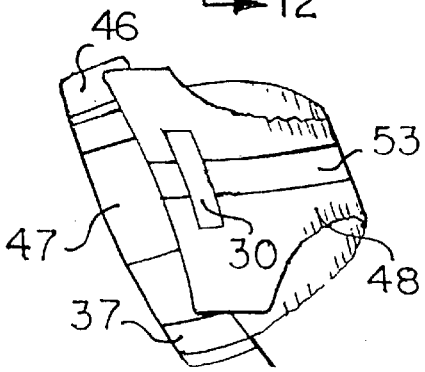
FIG. 13 is a perspective view of the undergarment assembly viewed as it is delivered in half folded form from apparatus of FIG. 9 and the embodiment of FIG. 15.

FIG. 13 shows size reduction in length without longitudinal panel folds for width reduction.

In FIG. 15, folding roll 76 has a plurality of vacuum ports 77 arranged along fold line F1–F1' of FIG. 14 for folding a previously cut rectangular segment.

The arrangement of FIG. 15 die cuts a symmetrical 'hourglass' shape after folding, therefore, this embodiment is limited to webs not being longitudinally for width reduction.

In FIG. 15 anvil roll 78 and knife roll 79 sever the web into rectangular segments.

The leading panel 47 of FIGS. 14 and 15 adheres to the surface of vacuumized anvil roll 78 until vacuum is stopped at about 260 degrees as shown.

The trailing panel 48 is held securely by a greater plurality of ports in roll 76 so when lead panel 47 is stripped from roll 78 and superposed on top of the trailing panel, the greater vacuum area now holds the mult-ply folded product against anvil roll 76. External belts 81 can also be used.

The folded product is shaped by coacting anvil roll 76 and die roll 82 and advanced by transfer roll 83 to delivery roll 84 for stacking as described above.

In FIG. 16, belt transport/folding system 51 includes plenum 85 with open top slot 86 and exrended protrusions 87 which support screen belt 88.

Web assembly 89 is supported and advanced by belt 88, and during advancement has longitudinal side panels 90 and 90' folded upward and toward the center by folding rods 91 and 91' respectively for product width reduction.

It is further to be understood that the present invention may be embodied in other specific forms without departing from the spirit or special attributes; and it is, therefore, not restrictive, reference being made to the appended claims rather than to the foregoing description to indicate the scope of the invention.

Having thus described the invention, what is claimed as new and desired to protect by letters patent are the following:

1. Apparatus for fabricating an undergarment assembly having a reclosable opening in a front panel, said apparatus including:

means to position first and second web supply rolls on transversely spaced centerlines, said first and second webs each having a width substantially equal to one half the product plus an amount for overlap, means to advance said first web along a first path, means to advance said second web along a second path, a first means to apply bonding agent to a longitudinally spaced area of one of the webs facing the other of said webs, means to partially superpose said second web and said first web in partially overlapped relationship along a conjoined path to form an assembly having innermost and outermost webs, means to bond spaced apart overlapped areas of said first web to said second web, said spaced bonded areas froming a unitary rear panel, means to advance, cut, and attach pairs of tapes, each having a portion extending from opposite sides of the undergarment assembly, means to advance, cut, and apply a release coated cover strip to each of said extending tape portions, said cover strip for removal by a user before the tapes are folded to connect the rear and front panels, means to advance, cut, and attach a tape to the half width web, said tape extending beyond the overlapped margin of said first web and protruding over said second half width web for attachment of said first and second half width webs to form the connected front panel of the assembly, means to cut leg opening portions along non-overlapped side margins of said conjoined first and second web assembly, means to transversely cut said bonded rear panel and connected front panel into the undergarment assembly means to remove said undergarment assembly from said conjoined path.

2. The apparatus of claim 1 wherein said bonding agent applicator means applies bonding agent to a surface of said second web facing said first web.

3. The apparatus of claim 1 wherein said means to cut said leg openings includes means to cut pad securement flaps extending from a margin within said leg openings in each of said first and second webs.

4. The apparatus of claim 1 wherein said assembly path removal means is a vacuumized transfer roll.

5. The apparatus of claim 1 wherein said path removal means is a vacuumized transfer roll in folding cooperation with a roll having at least one anvil, substantially flush with the surface of said anvil roll, and arranged parallel with the axis of rotation of the anvil roll.

6. The apparatus of claim 1 wherein means to apply said front panel connection tape includes means to apply a tape protrusion to a release coated receptor area on one of the webs.

7. The apparatus of claim 1 wherein said path removal means includes electronically actuated means to change duration of vacuum applied to said path removal means.

8. The apparatus of claim 1 wherein said segment path removal means includes said means to cut said leg openings before removal from said path.

9. The apparatus of claim 1 wherein said path removal means includes cooperating endless belts in contacting relationship with the undergarment assembly held against a surface of said path removal means.

10. The apparatus of claim 1 wherein said leg opening cutting means is arranged in timed relationship with said undergarment assembly to cut said leg openings symmetrically about a line substantially midway between end margins of said cut segment assembly.

11. The apparatus of claim 1 wherein said tape advancement, cutoff and attachment means for the tape pairs and the overlapping front panel tape are arranged to attach said tapes to the underside of said undergarment assembly.

12. The apparatus of claim 1 including means to transfer and attach a consecutive series of spaced absorbent pads to a series of spaced adhesive receptor areas on the inner most web.

13. The apparatus of claim 1 wherein said aparatus is arranged to transfer and attach a plurality of tensioned elastic strands between said first and second half width webs.

14. The apparatus of claim 1 wherein said means to advance said second web is arranged to orient said second web underneath said first web viewed in the direction of advancement.

15. The apparatus of claim 1 wherein said path removal means includes a roll having a plurality of vacuum ports along a transverse line that bisects said leg openings.

16. The apparatus of claim 1 including means to advance a third web, fold said web longitudinally, change the advancement direction of the third web, fold said third web to web to reverse inside and outside surfaces, and enclose at least one of the first and second webs within the third web.

17. The apparatus of claim 1 including means to longitudinally fold a side margin on each of said first and second webs after advancement to said leg opening cutting means.

18. A method of combining two webs to form an undergarment assembly including:

providing a first web and a second web each having a width substantially equal to one half the assembly width, advancing said first web along a first path, advancing said second web along a second path transversely offset from the first path, applying a bonding agent to a longitudinally spaced plurality of areas on one of said webs, said areas facing the other of said webs, superposing said first and second webs in partially overlapped relationship to form an assembly, joining said first and second webs to bond said webs in said longitudinally spaced areas to form a unitary rear panel, attaching a pair of tapes, each having a portion protruding from opposite side margins of the undergarment assembly, applying a release cover strip to tape portions protruding from the side margins, attaching at least one tape over an overlapped margin of the first and second webs to connect both webs to form a front panel with a non-bonded opening, cutting a curvilinear leg opening portion from non-overlapped side margins of the assembled web, severing said joined and connected half width webs into discreet undergarment assemblies, removing said assemblies from said conjoined assembly path.

* * * * *